US011650534B2

(12) United States Patent
Oh et al.

(10) Patent No.: US 11,650,534 B2
(45) Date of Patent: May 16, 2023

(54) WASTE TONER COLLECTING DEVICE FOR INCREASING WASTE TONER COLLECTING EFFICIENCY

(71) Applicant: HEWLETT-PACKARD DEVELOPMENT COMPANY, L.P., Spring, TX (US)

(72) Inventors: Hyun-taek Oh, Suwon (KR); Suhyun Kim, Suwon (KR); Euntae Jung, Suwon (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/288,854

(22) PCT Filed: Dec. 23, 2019

(86) PCT No.: PCT/US2019/068286
§ 371 (c)(1),
(2) Date: Apr. 26, 2021

(87) PCT Pub. No.: WO2020/205018
PCT Pub. Date: Oct. 8, 2020

(65) Prior Publication Data

US 2022/0011715 A1 Jan. 13, 2022

(30) Foreign Application Priority Data

Apr. 3, 2019 (KR) ..... 10-2019-0038910

(51) Int. Cl.
*G03G 21/10* (2006.01)
*G03G 15/08* (2006.01)
*G03G 21/12* (2006.01)

(52) U.S. Cl.
CPC ..... *G03G 21/105* (2013.01); *G03G 15/0891* (2013.01); *G03G 21/12* (2013.01)

(58) Field of Classification Search
CPC ..... G03G 21/105; G03G 21/12
See application file for complete search history.

(56) References Cited

U.S. PATENT DOCUMENTS 5,548,374 A 8/1996 Iguchi et al.
5,950,062 A * 9/1999 Yahata ..... G03G 21/105 399/99
6,466,763 B1 10/2002 Campbell et al.
7,103,308 B2 9/2006 Wakana
7,324,780 B2 1/2008 Yamada et al.
8,428,475 B2 * 4/2013 Tomita ..... G03G 21/12 399/35

(Continued)

FOREIGN PATENT DOCUMENTS

JP 11119619 A * 4/1999
JP 2011064812 A 3/2011
JP 2012042789 A * 3/2012

*Primary Examiner* — Walter L Lindsay, Jr.
*Assistant Examiner* — Milton Gonzalez
(74) *Attorney, Agent, or Firm* — Foley & Lardner LLP

(57) ABSTRACT

An image forming apparatus includes a print engine, a waste toner collecting device, and a waste toner transfer auger. The waste toner collecting device includes a waste toner container, a sensor disposed on one side of the waste toner container, and a rotatable dispersing member which moves waste toner flowing into the waste toner container to another side of the waste toner container.

19 Claims, 5 Drawing Sheets

(56) References Cited

U.S. PATENT DOCUMENTS

| | | | | |
|---|---|---|---|---|
| 8,655,205 | B2 | 2/2014 | Karasawa et al. | |
| 9,086,674 | B2 * | 7/2015 | Mekada | G03G 21/105 |
| 9,158,266 | B2 * | 10/2015 | Satoh | G03G 21/105 |
| 9,285,758 | B1 | 3/2016 | Boettcher et al. | |
| 9,395,678 | B2 | 7/2016 | Karasawa et al. | |
| 9,575,459 | B2 * | 2/2017 | Lee | G03G 21/105 |
| 9,880,511 | B2 * | 1/2018 | Takahashi | G03G 21/12 |
| 2011/0097124 | A1 | 4/2011 | Koike et al. | |

* cited by examiner

WASTE TONER COLLECTING DEVICE FOR INCREASING WASTE TONER COLLECTING EFFICIENCY

BACKGROUND

An image forming apparatus is an apparatus for developing a black-and-white image and a color image on a paper sheet according to an image signal. Representative examples of the apparatus include a printer, a copy machine, a facsimile, etc.

An image forming apparatus of an electrophotographic type outputs a predetermined image by forming an electrostatic latent image into a visible toner image by attaching a toner to a photosensitive drum on which the electrostatic latent image is formed, and transferring the toner image onto paper sheet.

DETAILED DESCRIPTION

The disclosure is not limited to the examples disclosed below and may be implemented in various forms and the scope of the disclosure is not limited to the following examples. In addition, all changes or modifications derived from the meaning and scope of the claims and their equivalents should be construed as being included within the scope of the disclosure. In the following description, the configuration which is publicly known but irrelevant to the gist of the disclosure may be omitted. In addition, the attached drawings are not drawn to scale to facilitate understanding of the disclosure, and the dimensions of some of the components may be exaggerated.

Figure 1:
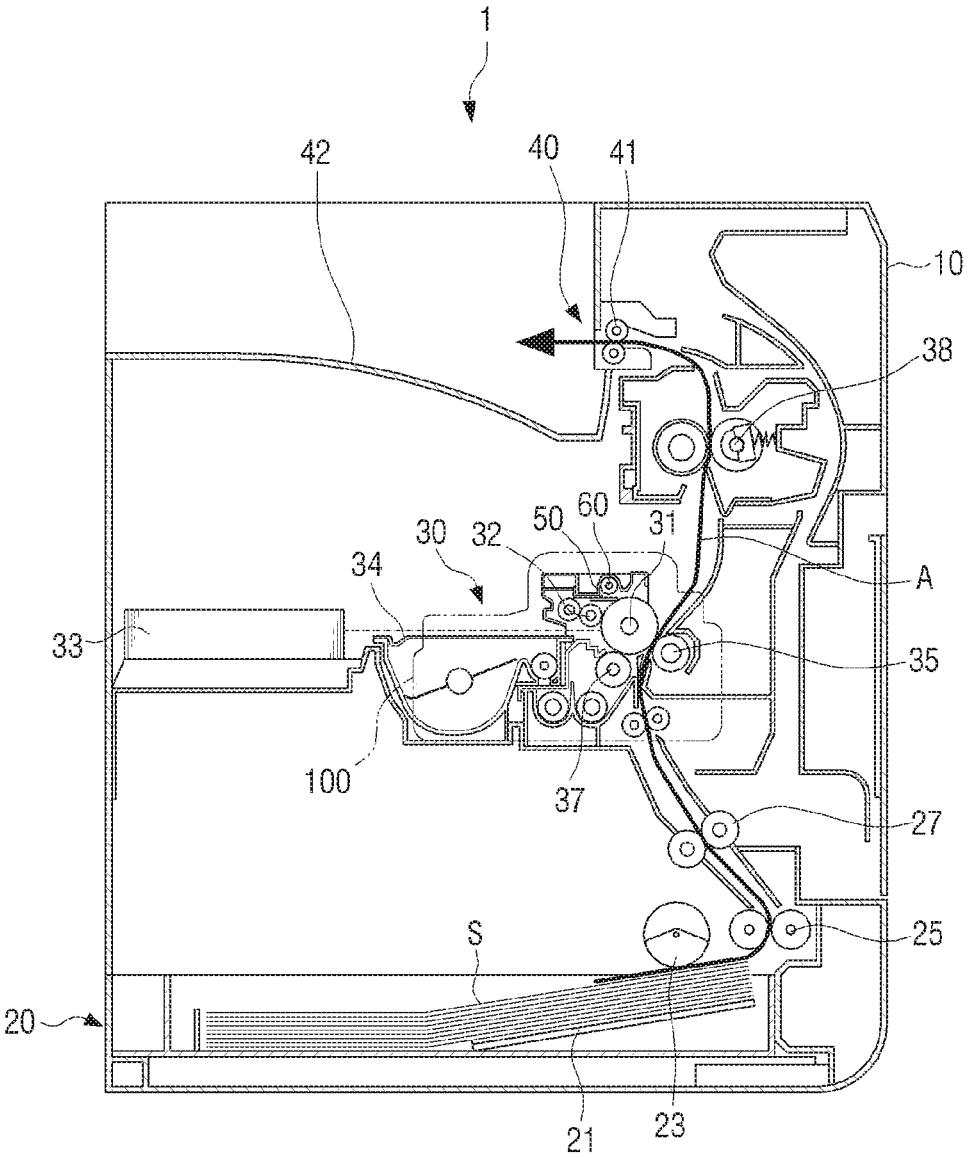
FIG. 1 is a schematic cross-sectional view illustrating an image forming apparatus according to an example.

Referring to FIG. 1, an image forming apparatus 1 according to according to an example is described, and then a waste toner collecting device 100 will be described in detail.

FIG. 1 is a schematic cross-sectional view illustrating an image forming apparatus according to an example.

The image forming apparatus 1 may include a main body 10, a paper feeding device 20, a print engine 30, and a discharge device 40.

The main body 10 may form an external appearance of the outside of the image forming apparatus 1 and support various components mounted therein.

The paper feeding device 20 may include a paper feeding tray 21 on a lower part of the main body 10, a pick-up roller 23 for picking up paper S loaded in the paper feeding tray 21 one piece by one piece, a registration roller 25 for providing a transfer force to the picked up paper S and aligning paper S to allow an image to be transferred onto a portion of the paper S, and a paper feeding roller 27 for loading the paper S between the photosensitive drum 31 and the transfer roller 35.

The print engine 30 may form a predetermined image onto the paper S supplied from the paper feeding device 20. The print engine 30 may include a photosensitive drum 31, a charger 32, an exposure device 33, a developing device 34, a transfer roller 35, and a fixing device 38. Although the print engine 30 and the paper feeding device 20 are illustrated as different configurations, but the paper feeding device 20 may be included in the print engine 30.

The electrostatic latent image may be formed in the photosensitive drum 31. The photosensitive drum 31 may form an image by operations of the charger 32 and the exposure device 33. The photosensitive drum 31 may be referred to as an image forming medium, a photosensitive drum, a photosensitive belt, etc. according to its form.

For ease of explanation, the configuration of the print engine 30 corresponding to a single color will be described, but in the implementation, the print engine may include a plurality of photosensitive drums, a plurality of chargers, a plurality of exposure devices, and a plurality of developing devices, an intermediate transfer belt, etc. corresponding to a plurality of colors.

The charger 32 may charge the surface of the photosensitive drum 31 to a uniform potential. The charger 32 may be implemented in the form of a corona charger, a charging roller, a charging brush, or the like.

The exposure device 33 may form an electrostatic latent image on the surface of the photosensitive drum 31 by changing a surface potential of the photosensitive drum 31 according to image information to be printed.

The developing device 34 may include a developer therein and supply a developer to the electrostatic latent image to develop the electrostatic latent image into a visible image. The developing device 34 may include a developing roller 37 which supplies the developer to the electrostatic latent image.

The transfer roller 35 may be mounted to face an outer circumferential surface of the photosensitive drum 31. The toner developed onto the outer circumferential surface of the photosensitive drum 31 may be transferred to the paper S passing through between the transfer roller 35 and the photosensitive drum 31 by contact pressure force between a transfer bias or the photosensitive drum 31 and the transfer roller 35.

The fixing device 38 may fix the toner to the paper S by applying heat and pressure to a visible image on print paper.

The discharge device 40 may include a paper discharge roller 41 for discharging the paper S passing through the fixing device 38 and having a predetermined image printed thereon to a paper discharge tray 42 outside the main body 10.

A print process of the image forming apparatus 1 will be briefly described. The photosensitive drum 31 may be charged to a predetermined potential though the charger 32, an electrostatic latent image corresponding to an image to be printed on the outer circumferential surface may be formed in response to light scanned from the exposure device 33. The toner in the developing device 34 may be supplied to the photosensitive drum 31 in which the electrostatic latent image is formed through the developing roller 37, and a visible image may be developed on the outer circumferential surface of the photosensitive drum 31.

The paper S may move along a movement path A. The paper S loaded at the top of the paper feeding tray 21 may be picked up by the pick-up roller, and aligned and fed by the registration roller 25 and the paper feeding roller 27 to pass through between the photosensitive drum 31 and the transfer roller 35. The toner image developed on the outer circumferential surface of the photosensitive drum 31 may be transferred on the opposite surface to the photosensitive drum 31. The toner image transferred onto the paper S may pass through the fixing device 38 to be fixed to the paper S by heat pressure, transferred by the paper discharge roller 41, and loaded in the paper discharge tray 42.

In the process of developing an image onto the paper S using the toner, waste toner may be inevitably generated by the print engine 30. Therefore, the print engine 30 may include a cleaning member 50 for removing waste toner generated after a transfer process.

One side of the cleaning member 50 may contact a side surface of the photosensitive drum 31 along the length direction of the photosensitive drum 31 with a predetermined pressure, and remove waste toner that remains in the photosensitive drum 31 after a transfer process is completed.

The image forming apparatus 1 may include a waste toner transfer auger 60 for transferring waste toner generated by the print engine 30 to the waste toner collecting device 100, and a waste toner collecting device 100 for collecting the transferred waste toner.

The waste toner transfer auger 60 may be mounted in the developing device 34 to rotate in a predetermined direction. The waste toner transfer auger 60 may transfer waste toner removed by the photosensitive drum 31 due to rotation to the waste toner collecting device 100 along an axial direction of the photosensitive drum 31.

The waste toner collecting device 100 may be formed on one end portion of the main body 10 to store waste toner transferred by the waste toner transfer auger 60. The waste toner collecting device 100 may be separably disposed on one side of the main body 10.

As described above, the configuration of an image forming apparatus according to an example has been described in detail, but a developing method is not limited thereto. The configuration of an image forming apparatus according to a developing method is subject to various modifications and changes.

Figure 2:
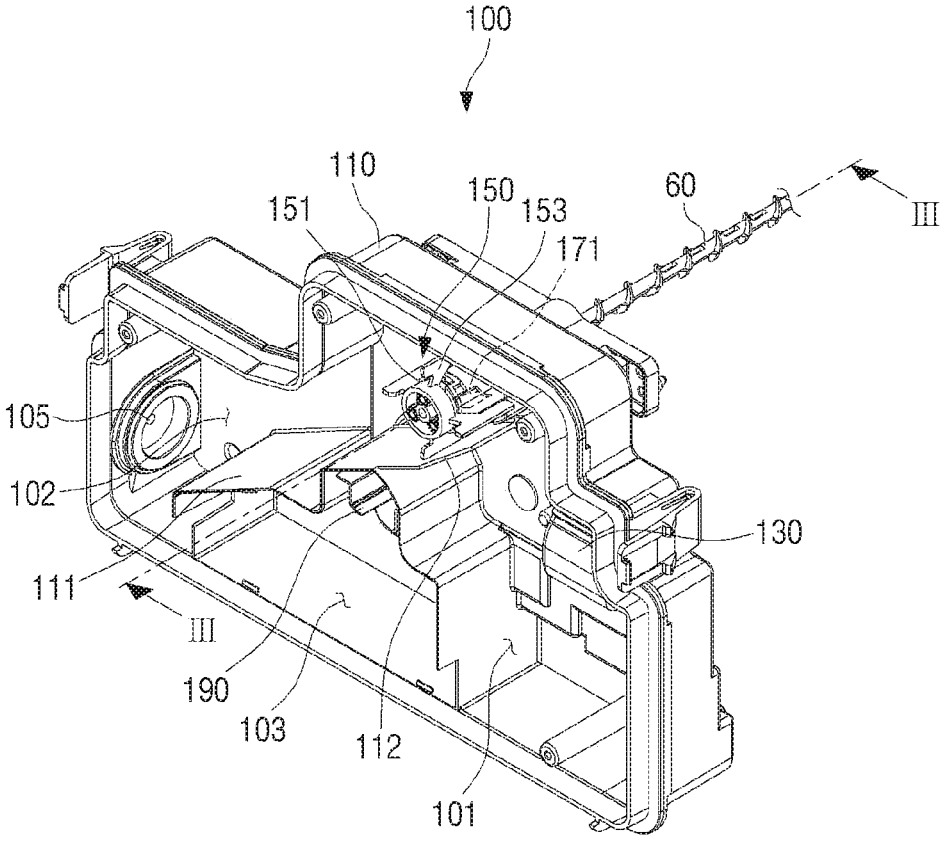
FIG. 2 is a perspective view illustrating a waste toner transfer device and a waste toner collecting device of an image forming apparatus according to an example.
Figure 3:
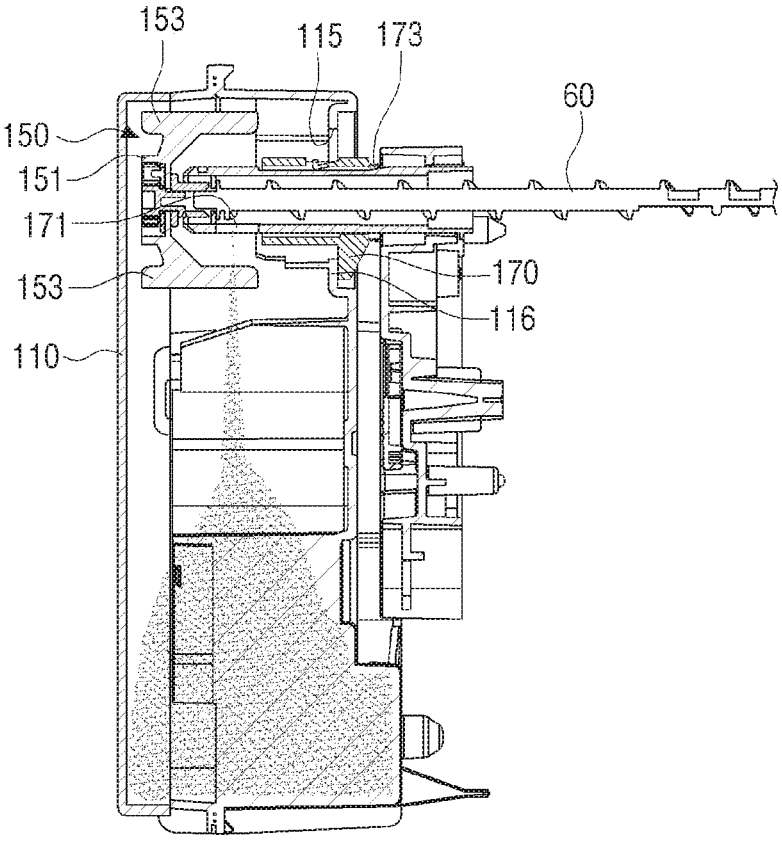
FIG. 3 is a cross-sectional view taken along line III-III of FIG. 2.

FIG. 2 is a perspective view illustrating a waste toner transfer device and a waste toner collecting device of an image forming apparatus according to an example, and FIG. 3 is a cross-sectional view taken along line III-III of FIG. 2.

For ease of explanation, FIG. 2 and FIG. 3 illustrate a waste toner collecting device 100 and a waste toner transfer auger 60 in a state where the waste toner collecting device 100 is mounted on the main body 10.

Referring to FIG. 2 and FIG. 3, the waste toner transfer auger 60 mounted in the main body 10 and rotating in a predetermined direction may transfer waste toner removed by the photosensitive drum 31 to the waste toner collecting device 100 along an axial direction of the photosensitive drum 31. One end of the waste toner transfer auger 60 may be coupled to the waste toner collecting device 100 to be disposed inside the waste toner collecting device 100.

The waste toner collecting device 100 may include a waste toner container 110 for storing waste toner, a sensor 130 for detecting the amount of waste toner collected and accumulated in the waste toner container 110, and a rotatable dispersing member 150 for moving part of the waste toner flowing into the waste toner container to the opposite side.

The waste toner container 110 may form a collecting space inside for collecting waste toner, and collect waste toner discharged from a waste toner inlet 171. The waste toner container 110 may be detachably attached to one side of the main body 10. When water toner is full in the waste toner container 110, the waste toner container 110 may be detached from the main body 10, and discharge waste toner to the outside through the waste toner output 105. The empty waste toner container 110 may be mounted on the main body 10.

The inside of the waste toner container 110 may be divided to a plurality of spaces by a collecting case 111. The collecting case 111 may be divided into upper spaces 101 and 102 and a lower space 103. The upper spaces 101 and 102 may be spaces where waste toner including impurities discharged through the waste toner inlet 171 is collected, and the lower space 103 may be a space where a waste developer discharged from a waste developer inlet 190 is collected.

The collecting case 111 may be integrally formed with the waste toner container 110.

A guide wall 112 may be provided on the upper side of the collecting case 111. The guide wall 112 may be upwardly inclined in one direction of the waste toner container 110. The guide wall 112 may be upwardly inclined in a direction where a sensor 130 is disposed. One side of the guide wall 112 may be disposed on the lower side of the waste toner inlet 171.

The upper spaces 101 and 102 of the guide wall 112 may include a first area 101 formed on the right side of the guide wall 112, and a second area 102 formed on the left side of the guide wall 112. The first area 101 may be an area where the sensor 130 is disposed, and the second area 102 may be an area where the sensor 130 is not disposed.

The waste toner outlet 105 for discharging waste toner collected in the waste toner container 110 to the outside may be disposed on the other side opposite to one side of the waste toner container 110 where the sensor 130 is disposed. The waste toner outlet 105 may be disposed in the second area 102.

The first area 101 and the second area 102 may be connected to each other, and divided based on the guide wall 112, but are not limited thereto. The first area 101 may be an area where the sensor 130 is disposed, and the second area 102 may be an area where the sensor 130 is not disposed.

The dispersing member 150 may move the waste toner to the second area 102 where the sensor 130 is not disposed, so that usability of the waste toner container 110 of the waste toner collecting device 100 increases and the replacement cycle of the waste toner collecting device 100 increases, thereby enhancing the convenience of a user.

The guide wall 112 may guide the waste toner flowing from the waste toner inlet 171 to the second area 102. Therefore, the guide wall 112 may guide the waste toner flowing into the waste toner container 110 to the second area 102 where the sensor 130 is not disposed to improve the storage efficiency of the waste toner container 110.

The sensor 130 may be disposed in the waste toner container 110. The sensor 130 may waste toner accumulated up to a mounting height. The sensor 130 may be disposed in the upper spaces 101 and 102 to sensor whether the upper spaces 101 and 102 are fully filled.

The sensor 130 may be disposed in the first area 101 of the upper spaces 101 and 102. The sensor 130 may be disposed at a height lower than the waste toner inlet 171. The sensor 130 may detect the amount of waste toner collected and accumulated at a predetermined height of the waste toner container 110 and prevent the waste toner accumulated in the waste toner container 110 from being flowing into the waste toner inlet 171 again. The sensor 130 may be disposed at a height similar to as same as the waste developer inlet 190 in the lower space 103 of the waste toner container 110.

The waste toner inlet 171 may be provided above the upper spaces 101 and 102. The waste toner flowing through the waste toner inlet 171 may be dispersed and accumulated in the first area 101 and the second area 102. If the waste toner accumulates at a height equal to or more than that of the sensor 130 in the first area 101, the processor (not shown) of the image forming apparatus 1 may determine that the upper spaces 101 and 102 are full.

For example, the sensor may be an optical sensor including a light emitting unit and a light receiving unit. If the waste toner accumulates at a height more than that of the sensor 130 in the first area 101, part of light may be blocked by waste toner, and the amount of light incident on the light receiving unit may be reduced. If the amount of light detected by the light receiving unit is equal or less than a reference amount, it may be determined that the upper spaces 101 and 102 are full. In this case, the processor (not shown) of the image forming apparatus 1 may determine that the upper spaces 101 and 102 are full, and inform the user of this, so that the user may replace the waste toner container 110.

An insert hole 115 into which a waste toner transfer auger 60 is inserted may be formed one side of the waste toner container 110. When the waste toner container 110 is mounted on the main body 10, one end of the waste toner transfer auger 60 may be disposed inside the waste toner container 110 through the insert hole 115. The waste toner transfer auger 60 may allow the waste toner to flow into the waste toner container 110 while being inserted into the insert hole 115.

The waste toner container 110 may include the waste toner inlet 171. The waste toner inlet 171 may be provided on the upper end of the waste toner container 110. The waste toner inlet 171 may be formed on one end of the waste toner transfer auger 60 to be opened and closed by a shutter 170

The waste toner inlet 171 may be formed in a portion of the waste toner transfer auger 60 flowing into the inside of the waste toner container 110. The waste toner inlet 171 may be formed to be opened downwardly such that the waste toner drops toward a bottom of the waste toner container 110.

The waste toner transfer auger 60 may include the shutter 170 for opening and closing the waste toner inlet 171.

When the waste toner collecting device 100 is mounted on the main body 10, the shutter 170 may be pushed in a direction of the main body 10 by a push groove 116 formed on an outer wall surface of the waste toner container 110 to open the waste toner inlet 171. In this case, the rear end of the shutter 170 may be elastically supported by the elastic member 173.

When the waste toner collecting device 100 is separated from the main body 10, a pressing force in the direction of the main body 10 by the push groove 116 may be removed, and the shutter may move in the direction of the waste toner collecting device 100 by the elastic member 173 to close the waste toner inlet 171.

A dispersing member 150 to move part of the waste toner flowing into the waste toner container 110 to the opposite side to the sensor 130 may be provided inside the waste toner container 110.

The dispersing member 150 may include a coupling member 151 coupled to one end of the waste toner transfer auger 60, and a plurality of blades 153 extending from the outer circumferential surface of the coupling member 151 across the waste toner inlet 171.

The dispersing member 150 may be rotationally disposed in the waste toner inlet 171. The dispersing member 150 may be mounted on one side of the waste toner transfer auger 60, and rotate together with the waste toner transfer auger 60 by the rotation of the waste toner transfer auger 60.

The dispersing member 150 may rotate in a direction to move part of the waste toner flowing through the waste toner inlet 171 to the second area 102 opposite to the sensor 130. The rotational direction of the dispersing member 150 may be determined according to the location of the sensor 130.

For example, referring to FIG. 2, when the sensor 130 is mounted on the right side of the waste toner inlet 171, the dispersing member 150 may be disposed to rotate in a clockwise direction to move the waste toner to the left side. When the sensor 130 is mounted on the left side of the waste toner inlet 171, the dispersing member 150 may be disposed to rotate in a counterclockwise direction to move the waste toner to the right opposite to the sensor.

The dispersing member 150 may disperse the waste toner by moving part of the waste toner flowing into the waste toner container 110 by rotation to one side. For example, the dispersing member 150 may move the waste toner to the second area 102 opposite to the sensor 130.

The dispersing member 150 may disperse waste toner by moving the waste toner accumulated in the waste toner container 110 to one side.

Part of the waste toner flowing into the waste toner container 110 through the waste toner inlet 171 may drop by its weight and accumulate right under the waste toner inlet 171. In the case of waste toner, impurities such as fabric components, etc. of paper may be included in a print process. Therefore, it may have lower fluidity than a new toner, and a high coherence. In such a manner, the waste toner flowing into the waste toner container 110 may accumulate in a mountain-like shape.

The dispersing member 150 may directly hit the upper portion of the waste toner which accumulates in a mountain-like shape to move it to the second area 102. Therefore, the waste toner accumulated in a mountain-like shape under the waste toner inlet 171 may flow into the main body 10 through the waste toner inlet 171, so that the image forming apparatus 1 may be prevented from being contaminated by the waste toner.

The dispersing member 150 may prevent the waste toner accumulating under the waste toner inlet 171 in a vertical direction, so that the waste toner may be uniformly loaded in the waste toner container 110.

The detailed shape and structure of the dispersing member 150 will be described below.

Figure 4:
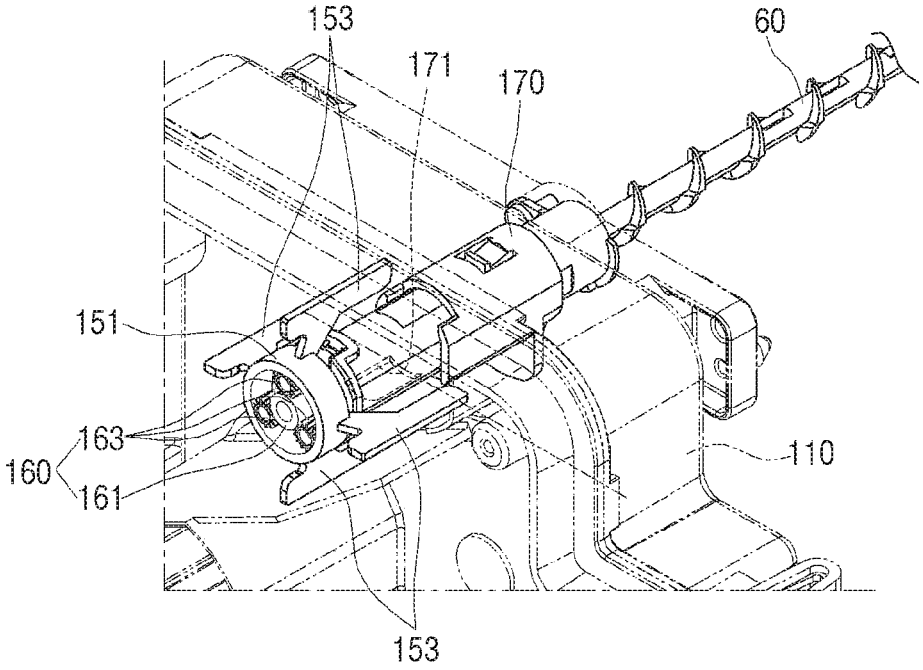
FIG. 4 is a perspective view of a dispersing member disposed in a waste toner container according to an example.

FIG. 4 is a perspective view of a dispersing member disposed in a waste toner container according to an example.

Referring to FIG. 4, the dispersing member 150 may include a coupling member 151 coupled to one end of the waste toner transfer auger 60, and a plurality of blades 153 extending from the outer circumferential surface of the coupling member 151 across the waste toner inlet 171.

The coupling member 151 may be coupled to one end of the waste toner transfer auger 60. The coupling member 151 may be disposed lower than the waste toner inlet 171, but at a distal end of the waste toner transfer auger 60.

The coupling member 151 may be coupled to the waste toner transfer auger 60 by at least one gear 160. The gear connecting between the coupling member 151 and the waste toner transfer auger 60 may be determined according to the rotational direction of the dispersing member 150.

For example, when the rotation direction of the dispersing member 150 and the rotational direction of the waste toner transfer auger 60 are opposite to each other such as the waste toner transfer auger 60 may rotate in a first direction, and the dispersing member 150 rotates in a second direction, which is a reverse direction of the first direction, the dispersing member 150 and the waste toner transfer auger 60 may be connected by a planetary gear 163.

Referring to FIG. 4, the coupling member 151 and an inside gear 161 may be disposed in a concentric structure with a plurality of planetary gears 163 interposed therebetween.

The inside gear 161 may rotate in a direction together with the waste toner transfer auger 60, the plurality of planetary gears 163 engaged with the inside gear 161 may rotate in a second direction, which is a reverse direction of the first direction, and the coupling member 151 disposed on the outer circumferential surface to be engaged with the planetary gear 163 may rotate in a second direction. If the coupling member 151 rotates, the plurality of blades 153 formed on the outer circumferential surface of the coupling member 151 may rotate in the second direction.

The planetary gear 163 may transmit the rotational force of the inside gear 161 to the coupling member 151, and the planetary gear 163 may include a plurality of planetary gears between the inside gear 161 and the coupling member 151. Threads respectively corresponding to the inside gear 161, the coupling member 151 and the planetary gear 163 may be formed to effectively transmit the rotational force.

FIG. 4 illustrates that the dispersing member 150 and the waste toner transfer auger 60 rotate oppositely, but is not limited thereto. When the dispersing member 150 and the waste toner transfer auger 60 rotate in the same direction such as the dispersing member 150 rotates in the first direction, and the waste toner transfer auger 60 rotates in the first direction, the dispersing member 150 and the waste toner transfer auger 60 may be connected by an internal gear.

In this case, an internal gear may be mounted outside the waste toner transfer auger 60, and when the internal gear rotates together with the waste toner transfer auger 60, the internal surface of the coupling member 151 may be formed to be coupled to the outer surface of the internal gear so that the dispersing member 150 and the waste toner transfer auger 60 rotate in a same direction.

A plurality of blades 153 may be disposed on the outer circumferential surface of the coupling member 151. The plurality of blades 153 may be disposed along the outer circumferential surface of the coupling member 151 at a predetermined interval.

The blade 153 may be formed to pass through the lower portion of the waste toner inlet 171 into which the waster toner flows by the rotation of the dispersing member 150. Each of the plurality of blades 153 may extend across the waste toner inlet 171. Each of the plurality of blades 153 may extend in a direction from the coupling member 151 coupled to one side of the waste toner transfer auger 60 to the waste toner inlet 171.

Each of the plurality of blades 153 may be disposed to surround the outer circumferential surface of the waste toner transfer auger 60. The blade 153 may be disposed in parallel to the waste toner transfer auger 60.

The blade 153 may be disposed from the outer circumferential surface of the waste toner transfer auger 60 at a predetermined interval. The blade 153 may be disposed to be spaced apart from the outer circumferential surface of the shutter 170.

The blade 153 may pass through the lower portion of the waste toner inlet 171 by the rotation of the dispersing member 150. The blade 153 may move from the first area 101 to the second area 102 based on the waste toner inlet 171 and pass through the lower portion of the waste toner inlet 171.

Accordingly, the blade 153 may pass through the lower portion of the waste toner inlet 171 and move part of the waste toner flowing into the waste toner inlet 171 in the second area, which is a rotational direction. The blade 153 may move the part of the waste toner flowing into the waste toner inlet 171 to the opposite side of the sensor 130.

One surface of the blade 153 may be a dispersion surface on which part of the waste toner flowing into the waste toner inlet 171 drops. The part of the waste toner flowing from the waste toner inlet 171 and vertically dropping may drop onto the dispersion surface of the blade 153 rotating at the waste toner inlet 171 for a predetermined period of time and move to the second area 102.

The blade 153 may be radially disposed on the outer circumferential surface of the coupling member 151 and move the part of the waste toner flowing into the waste toner inlet 171 in the rotational direction of the dispersing member 150. FIG. 4 illustrates that the blade 153 is radially formed, but is not limited thereto. The blade 153 may be formed in various shapes. For example, the blade 153 may be formed in a shape corresponding to the outer circumferential surface of the waste toner transfer auger 60, and be formed to further include a surface perpendicular to the blade 153 which is radially formed.

The dispersing member 150 may disperse waste toner accumulated in the waste toner container 110 to the second area 102 and delay a time for the sensor 130 provided in the first area 101 to detect the saturation state of the waste toner container 110.

The amount of waste toner accumulated in the second area 102 may increase by the dispersing member 150 including the blade 153 for moving the waste toner in a direction opposite to the sensor 130, and therefore the storage efficiency of the storage space of the waste toner container 110 may be enhanced.

The process in which the waste toner collected in the waste toner collecting device 100 is dispersed by the dispersing member 150 will be described below.

Figure 5:
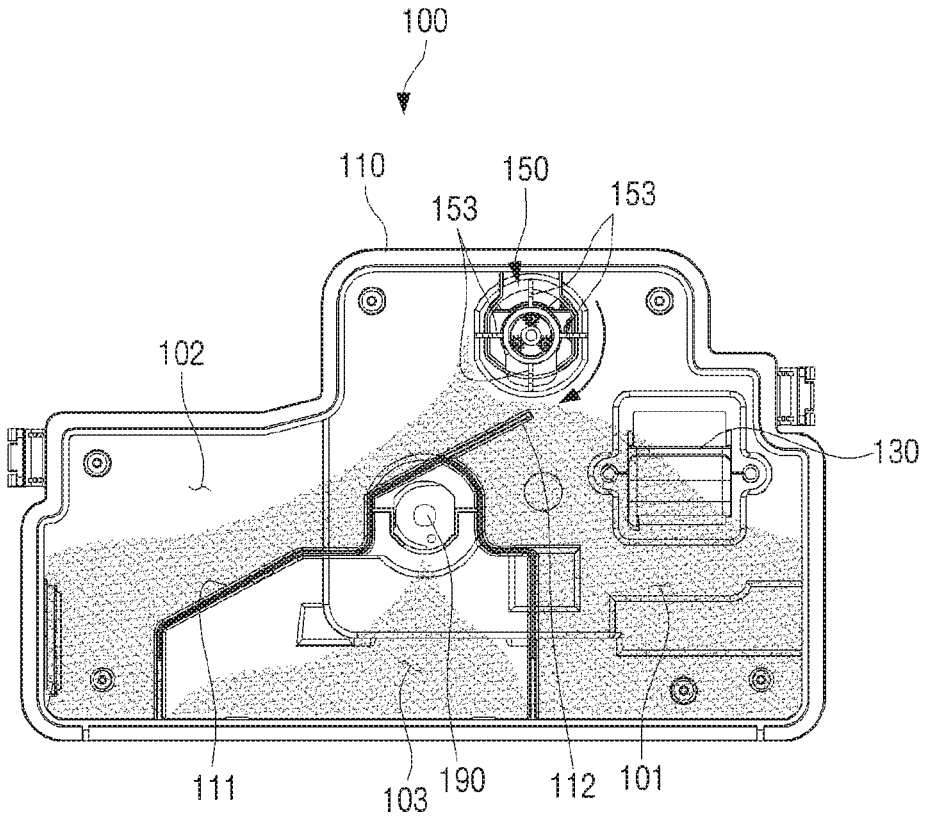
FIG. 5 is a front view illustrating a waste toner collecting device according to an example.

FIG. 5 is a front view illustrating a waste toner collecting device according to an example.

Referring to FIG. 5, part of the waste toner flowing into the waste toner inlet 171 may move to the second area 102 by the dispersing member 150 rotating in a clockwise direction at the waste toner inlet 171

The blade 153 under the waste toner inlet 171 may move from the first area 101 to the second area 102 and transfer waste toner flowing from the waste toner inlet 171 to the second area 102. Part of the waste toner may be pushed in the rotational direction of the blade 153 by one surface of the blade 153 and move to the second area 102.

In addition, air may flow from the first area 10 toward the second area in the lower part of the waste toner inlet 171 according to the rotation of the dispersing member 150, and the waste toner flowing into the waste toner container 110 in a scattered state by the rotation of the dispersing member 150 may move to the second area 102 alongside with air flow.

The waste toner transferred to the second area 102 by the blade 153 may arrive at the guide wall 112, and move to the second area 102 by the guide wall 112 downwardly inclined toward the second area 102.

Part of the remainder of the waste toner flowing into the waste toner inlet 171 may accumulate in a mountain-like shape right under the waste toner inlet 171, and the upper part of the waste toner in the mountain-like shape may be conveyed in the second direction by the dispersing member 150 rotating in a clockwise direction.

The blade 153 under the waste toner inlet 171 may move from the first area 101 to the second area 102 and hit the upper part of the waste toner in the mountain-like shape in a rotational direction to move the waste toner to the second area 102.

The waste toner may be accumulated in the mountain-like shape under the waste toner inlet 171, but the blade 153 rotationally moving to the second area 102 in the lower part of the waste toner inlet 171 may prevent the waste toner from accumulating in the mountain-like shape. Accordingly, torque rise or damage of the waste toner transfer auger 60 that can occur when waste toner flows into the waste toner transfer auger 60 may be prevented.

A waste developer discharged from the waste developer inlet 190 may be collected in the lower space 103. The dispersing member 150 may be additionally disposed in the waste developer inlet 190.

The dispersing member 150 according to an example of the disclosure may move part of the waste toner flowing into the waste toner container 110 to the opposite side to the sensor 130, and delay a time for the sensor 130 to detect the saturation state of the waste toner container 110. Accordingly, the capacity of the waste toner container 110 may be used at the maximum level, which results in using the waste toner collecting device 100 lasting longer, and extending the replacement cycle of the waste toner container 110. Therefore, user convenience may be improved.

The waste toner may be flattened because the waste toner can be evenly dispersed across the entire area of the waste toner container 110 through the dispersing member 150.

Further, the dispersing member 150 may be driven by the rotational force of the waste toner transfer auger 60, not a dedicated or separate source, which means it is driven by a driving force of an existing driving source, and it reduces manufacturing costs.

In addition, the dispersing member 150 may be disposed at the waste toner inlet 171 into which waste toner flows, and it does not interfere with a collecting device in which waste toner accumulates. Therefore, reducing a collecting space by providing a dispersing member may be avoided, and the minimization of the waste toner collecting device 100 may be achieved.

As described above, the disclosure has been described in view of various examples. The terms used herein are for explanation, not limitation. According to the various examples disclosed herein, various modifications and changes to the disclosure could be made. Therefore, unless otherwise additionally mentioned, the disclosure can be implemented in the scope of claims.

What is claimed is:

1. An image forming apparatus, comprising:

a print engine;

a waste toner transfer auger to rotate about a rotation axis; and a waste toner collecting device to collect a waste toner generated by the print engine and transferred from the print engine to the waste toner collecting device by the waste toner transfer auger, the waste toner collecting device including:

a waste toner inlet, a waste toner container to store waste toner discharged from the waste toner inlet, a sensor, disposed on one side of the waste toner container, to detect an amount of waste toner in the waste toner container, and a rotatable dispersing member to move waste toner discharged from the waste toner inlet into the waste toner container to another side of the waste toner container, opposite of the one side, wherein the dispersing member includes a coupling member coupled to the waste toner transfer auger by a gear, wherein the dispersing member includes a plurality of blades disposed on an outer circumferential surface of the coupling member that are rotatable about the waste toner transfer auger such that the plurality of blades are spaced apart from the waste toner inlet and move across the waste toner inlet.

2. The image forming apparatus as claimed in claim 1, wherein each of the plurality of blades is disposed to pass below a lower portion of the waste toner inlet by rotation of the dispersing member about the rotation axis.

3. The image forming apparatus as claimed in claim 1, wherein the plurality of blades of the dispersing member is to rotate in a direction from the one side toward the other side, and wherein the one side and the other side are positioned on radially opposite sides of the rotation axis.

4. The image forming apparatus as claimed in claim 1, wherein each of the plurality of blades extends in a direction from the coupling member toward the waste toner inlet.

5. The image forming apparatus as claimed in claim 1, wherein each of the plurality of blades is radially disposed on the outer circumferential surface of the coupling member at a predetermined interval.

6. The image forming apparatus as claimed in claim 1, wherein each of the plurality of blades is disposed to surround an outer circumferential surface of the waste toner transfer auger while being spaced apart from the outer circumferential surface of the waste toner transfer auger at a predetermined interval.

7. The image forming apparatus as claimed in claim 1, wherein each of the plurality of blades includes a dispersion surface, and waste toner discharged from the waste toner inlet is to drop onto the dispersion surface of each of the plurality of blades by rotation of the dispersing member.

8. The image forming apparatus as claimed in claim 7, wherein the dispersion surface of each of the plurality of blades is to move waste toner discharged from the waste toner inlet to the other side by rotation of the dispersing member.

9. The image forming apparatus as claimed in claim 1, wherein the sensor is disposed below the waste toner inlet.

10. The image forming apparatus as claimed in claim 1, wherein the one side and the other side of the waste toner container are divided by a guide wall positioned in the waste toner container.

11. The image forming apparatus as claimed in claim 1, wherein the gear comprises an inside gear and a plurality of planetary gears.

12. A waste toner collecting device mountable in an image forming apparatus, the waste toner collecting device comprising:

a waste toner transfer auger;

a waste toner inlet;

a waste toner container to store waste toner discharged from the waste toner inlet;

a sensor, disposed on one side of the waste toner container, to detect an amount of waste toner in the waste toner container; and a rotatable dispersing member having a rotation axis that is substantially coaxial with respect to the waste toner transfer auger, the rotatable dispersing member including a coupling member connectable to the waste toner transfer auger and a plurality of blades disposed on an outer circumferential surface of the coupling member, spaced apart from the waste toner inlet, and extending across the waste toner inlet, the plurality of blades being rotatable about the rotation axis and the waste toner transfer auger to move waste toner discharged from the waste toner inlet into the waste toner container to another side of the waste toner container, opposite of the one side.

13. The waste toner collecting device as claimed in claim 12, wherein each of the plurality of blades is disposed to pass below a lower portion of the waste toner inlet by rotation of the dispersing member.

14. The waste toner collecting device as claimed in claim 12, wherein the plurality of blades of the dispersing member is to rotate in a direction from the one side toward the other side, and wherein the one side and the other side are positioned on radially opposite sides of the rotation axis.

15. The waste toner collecting device as claimed in claim 12, wherein the one side and the other side of the waste toner container are divided by a guide wall positioned in the waste toner container.

16. A waste toner collecting device mountable in an image forming apparatus, the waste toner collecting device comprising:

a waste toner inlet;

a waste toner container to store waste toner discharged from the waste toner inlet; and a rotatable dispersing member that includes a coupling member connectable to a waste toner transfer auger, the rotatable dispersing member including a plurality of blades disposed on an outer circumferential surface of the coupling member, spaced apart from the waste toner inlet, and extending across the waste toner inlet, the plurality of blades being rotatable about the waste toner transfer auger to move waste toner discharged from the waste toner inlet into the waste toner container.

17. The waste toner collecting device as claimed in claim 16, wherein the coupling member is connectable to a distal end of the waste toner transfer auger.

18. The waste toner collecting device of claim 16, wherein the plurality of blades are to rotate about the waste toner transfer auger to move waste toner discharged from the waste toner inlet toward a first side of the waste toner container and away from a second side of the waste toner container, wherein the first side and the second side are positioned on radially opposite sides of a rotation axis of the waste toner transfer auger.

19. The waste toner collecting device of claim 18, wherein the first side and the second side of the waste toner container are divided by a guide wall positioned in the waste toner container.

* * * * *